United States Patent [19]

Fuhrmann et al.

[11] Patent Number: 4,830,432

[45] Date of Patent: May 16, 1989

[54] POSITIONING DEVICE

[75] Inventors: Castor Fuhrmann, Brachtendorf; Hans-Josef Hosan, Neuwied; Axel Knopp, Eitelborn; Gerd Würges, Urmitz, all of Fed. Rep. of Germany

[73] Assignee: Stabilus GmbH, Koblenz-Neuendorf, Fed. Rep. of Germany

[21] Appl. No.: 45,685

[22] Filed: May 1, 1987

[30] Foreign Application Priority Data

May 15, 1986 [DE] Fed. Rep. of Germany ..... 3616438

[51] Int. Cl.[4] ..... A47C 3/00

[52] U.S. Cl. ..... 297/304; 267/131; 297/306; 297/DIG. 3

[58] Field of Search ..... 297/300, 302, 304, 306, 297/DIG. 3; 188/300, 314; 267/186, 131, 132

[56] References Cited

U.S. PATENT DOCUMENTS

| | | | |
|---|---|---|---|
| 2,253,190 | 8/1941 | Mistral | 267/186 X |
| 3,140,118 | 7/1964 | Dorn | 297/302 X |
| 3,388,883 | 6/1968 | Axthammer et al. . | |
| 3,415,159 | 12/1968 | Hornlein et al. . | |
| 3,447,645 | 6/1969 | Dorner et al. . | |
| 3,652,126 | 3/1972 | Folling | 297/DIG. 3 X |
| 4,364,605 | 12/1982 | Meiller | 297/304 X |
| 4,479,679 | 10/1984 | Fries et al. | 297/304 X |
| 4,709,962 | 12/1987 | Steinmann | 297/304 X |

FOREIGN PATENT DOCUMENTS

| | | | |
|---|---|---|---|
| 131554 | 1/1985 | European Pat. Off. | 297/300 |
| 581679 | 8/1933 | Fed. Rep. of Germany | 297/304 |
| 2000172 | 12/1971 | Fed. Rep. of Germany | 297/306 |
| 2733322 | 2/1979 | Fed. Rep. of Germany . | |
| 2810276 | 9/1979 | Fed. Rep. of Germany | 297/300 |

*Primary Examiner*—Peter A. Aschenbrenner
*Assistant Examiner*—Thomas A. Rendos
*Attorney, Agent, or Firm*—Brumbaugh, Graves, Donohue & Raymond

[57] ABSTRACT

A positioning device is used for the positioning of a chair seat as to its inclination, or for positioning a backrest member of a chair. The positioning device is constructed such as usual hydropneumatic springs which can be locked by closing a passage connected to working chambers on both sides of a piston. The working chambers are filled with an operating liquid. In order to adapt the biasing force of such a positioning device, one of the working chambers is connected with a force-measuring device, which force measuring device is provided within the force transmission path of the respective chair column. The force measuring device comprises a measuring space filled with operating liquid, and this operating liquid is in liquid connection with one of the working chambers.

24 Claims, 3 Drawing Sheets

POSITIONING DEVICE

BACKGROUND OF THE INVENTION

A positioning device may be used for positioning a part of a complex structure such as a chair. The positioning device is constructed as a fluid-operated spring unit which biases the movable part in a predetermined direction. The fluid-operated spring can be adjusted into a plurality of operative lengths. The operative length is responsible for the respective position of the movable part. The adjustment of the movable part is performed in one direction by acting on the movable part against the action of the spring unit. After the desired position has been achieved, the spring unit is locked in usual way. In some cases, it is desirable to make the resistance of the spring unit variable in dependence of another force which occurs within the construction. One possible case is a chair. In such a chair the spring unit may be used for adjusting the back-rest in a position adapted to the anatomy of the user. For adjustment of the back-rest the user urges by his back onto the back-rest against the action of the spring unit after the spring unit has been unlocked. It is desirable that the spring resistance of the back-rest, which depends on the spring force of the spring unit, is adapted to the weight of the user such that the user can move by his back said back-rest without difficulty, on the one hand, and cannot tilt suddenly backwards due to insufficient spring resistance of the spring unit, on the other hand.

STATEMENT OF THE PRIOR ART

From German Pat. No. 2,733,322 a chair has been known which comprises a seat member and a back-rest. For varying the inclination of the back-rest a lockable gas spring is provided. A manually adjustable coil spring is in parallel with this gas spring. The spring force of this spring arrangement is adapted to a predetermined user by variation of the biasing force of the coil spring with the aid of a tool. If the spring arrangement is adapted to a person of normal weight, and the chair is thereafter used by a lightweight person without preliminary adaptation of the spring arrangement, the lightweight person has difficulties to vary the inclination of the back-rest against the biasing force of the combined spring arrangement. If, on the other hand, a heavyweight person uses the chair still adapted to a normal weight, the resistance of the spring arrangement is too small such that the person has the feeling of tilting backwards.

OBJECT OF THE INVENTION

It is an object of the present invention to provide a positioning device, the spring action of which occurring in the unlocked condition is adapted to a related force.

More particularly, it is an object of the present invention to provide a positioning device for adjustment of seat member inclination or back-rest inclination in a chair, which positioning device may be adjusted against the action of a spring force, and to make this spring force responsive to the weight of the person sitting on the chair.

SUMMARY OF THE INVENTION

This invention relates to a positioning device comprising a spring unit. The spring unit comprises a cylinder member having an axis and two ends and defining a cavity therein. A piston rod member extends inwards and outwards of one of said ends and is movable in axial direction of the cylinder. A piston unit is connected with the piston rod member within the cavity and separates two working chambers from each other within the cavity. Passage means interconnect the two working chambers. A valve means is associated to said passage means for voluntarily interconnecting and separating the working chambers. An operating fluid under pressure is contained within the working chambers. The operating fluid under pressure acts onto the piston unit and the piston rod member such as to drive the piston rod member outwards of the cavity when the valve means are open, and to position the piston rod in a substantially stationary position when the valve means are closed. At least one of the working chambers is connected by fluid conduit means with a pressure space of a force-measuring unit. This pressure space contains operating fluid under pressure. The pressure of the operating fluid within the pressure space is responsive to an external force acting onto the force measuring unit and determines the pressure of the operating fluid within the working chambers. So the spring action of the spring unit depends on the amount of external force acting onto the force measuring unit. The spring unit and the measuring unit define a closed system so that an easy installation into a complex system is possible. The spring unit and the measuring unit may be completed with the manufacture of the spring unit so as to be ready for installation in a complex construction such as a chair. The spring unit and the measuring unit may have considerable distance by corresponding lengths of said conduit means.

Preferably the working chambers and the pressure space contain an operating liquid, said operating liquid being maintained under pressure by biasing means. The use of an operating liquid is preferable in view of avoiding sealing problems which can occur when using an operating gas.

The biasing means may comprise, however, a volume of pressurized gas.

The volume of pressurized gas may be accommodated within the cavity without considerable sealing problems.

The volume of pressurized gas is adjacent to and separated from one of the working chambers by a separating wall member.

This separating wall member may be located adjacent to the working chamber which is remote from the piston rod member. In such case the separating wall may be a flexible wall member.

According to an alternative said separating wall member surrounds the piston rod and is in sealing engagement with both the piston rod member and the cylinder member.

For allowing longer distances between the spring unit and the measuring unit at least one of the working chambers may be connected with the pressure space by a tube member, preferably a flexible tube member.

The force measuring unit can easily be constructed as a housing having a measuring cylinder defined therein. A measuring piston can be slidable within the measuring cylinder such that the measuring space is defined by said measuring piston within the measuring cylinder. The housing and the measuring piston are subject to the external force. It is also possible to define the pressure space by at least one flexible wall.

In order to define a normal position of the forcemeasuring unit under the pressure of the operating fluid, the measuring piston may cooperate with abutment means operatively fixed with respect to the measuring cylinder, said abutment means defining the maximum volume of the pressure space.

These abutment means may be adjustable along an axis of the measuring cylinder such that the normal position of the force-measuring device may be varied.

In order to use the force-measuring unit as an external force transmission unit which may be subject to bending moments, the measuring piston should have a longitudinal extent larger than the diameter thereof.

According to an alternative the measuring piston is connected with a guiding piston, which guiding piston is guided in a guiding cylinder of the housing. This alternative also provides a high resistance against bending moments.

Particularly in case of a chair the measuring piston may be provided with a conical inner surface for self-locking engagement with a first force-transmitting member having a corresponding outer conical surface. Such an outer conical surface may be provided on the upper end of a chair column as is well known in the art.

In case of a guiding piston the inner conical surface may be provided within the guiding piston.

Also the housing may be provided with engagement means, namely for engagement with a second force-transmitting member, which second force-transmitting member is e. g. a seat member or a seat member carrier.

In case of a chair construction the force-measuring device will be located in the force-transmission path between a chair seat member and a chair foot member, and said spring unit is brought in operative connection with the chair seat member such as to control the inclination of the chair seat member.

According to an alternative the spring unit is brought in operative connection with a back-rest member of a respective chair for controlling the inclination thereof.

In both cases the force-measuring unit may have its housing fixed with respect to the seat member carrier, and the spring unit may be connected with the seat member carrier on the one hand and with one of said seat member and back-rest member on the other hand.

It is desirable that in case of a chair the force-measuring unit is integrated into the seat carrier such as to be invisible.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

The invention will be explained in greater detail hereinafter with reference to embodiments shown in the accompanying drawings, in which.

DESCRIPTION OF THE PREFERRED EMBODIMENTS

Figure 1:
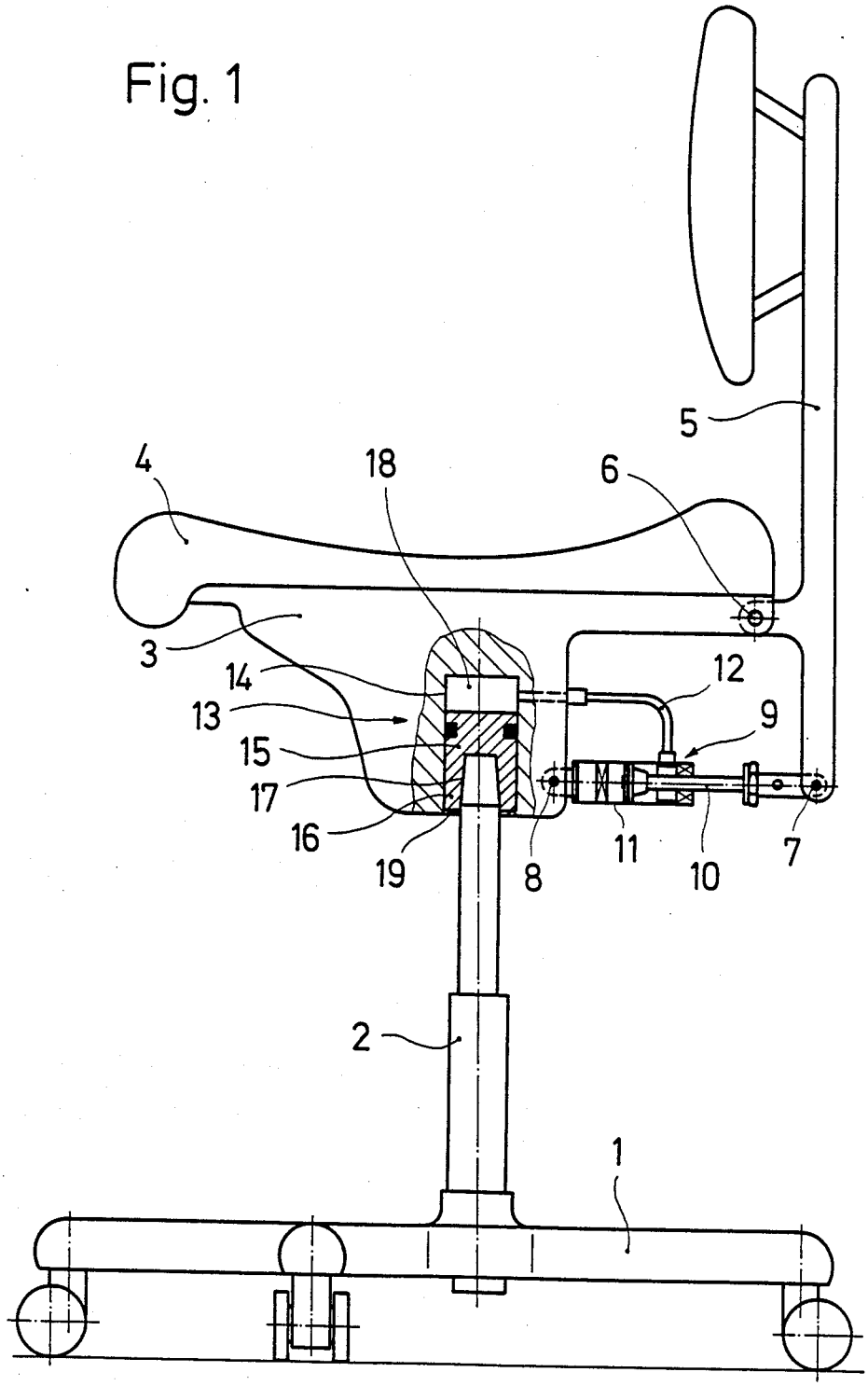
FIG. 1 shows a chair with a spring-forcevariable spring unit for adjustment of the inclination of a back-rest.

A hydropneumatic spring unit is shown in FIG. 1 as a part of a chair. This chair comprises a central chair column 2 connected with a chair foot member 1. This chair column 2 is connectable with a seat carrier 3 which carries a seat member 4. A back-rest 5 is mounted on the seat carrier 3 by a pivot 6 such that the inclination of the back-rest 5 can be varied. A lockable hydropneumatic spring unit 9 is by its piston rod 10 connected with the back-rest 5 through a pivot 7. The cylinder 11 is connected with the seat carrier 3 by a pivot 8. A flexible tube connects one working chamber of the hydropneumatic spring unit 9 with a force-measuring unit 13 to be described later.

The force-measuring unit 13 comprises a force-measuring cylinder 14 which slidingly receives a measuring piston 15 such as to define a measuring space 18 filled with operating liquid. If the required relationship between the pressure of the operating liquid 18 and the spring force variation of the piston rod 10 permits, the measuring piston 15 and the sliding piston 16 may be shaped as an integral member having constant diameter along its total length. The guiding length of the integral members 15 and 16 is such that bending moments are sufficiently resisted. The axial length of the integral members 15, 16 is preferably greater than the diameter thereof, and more particularly larger than 1.5 times the diameter. The guiding piston 16 may be connected with the central column 2 by a self-locking pair of interengaging cones 17. Abutment means 19 are provided which are engaged by the lower end face of the guiding piston 16 such as to axially limit the downward movement of the measuring piston 15.

Figure 2:
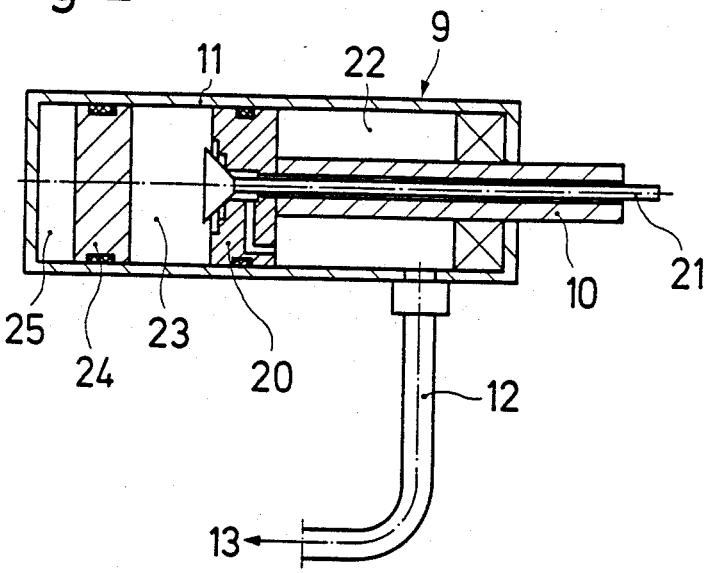
FIG. 2 shows the spring unit of FIG. 1 in an enlarged scale.

In FIG. 2 there is shown the hydropneumatic spring unit 9 which is in liquid connection with the force-measuring unit 13 by a flexible tube 12. This hydropneumatic spring unit comprises an operating rod 21 which is connected with a valve body. This valve body is part of a locking valve provided in a piston 20, which piston 20 is connected with the piston rod 10. The cavity within the cylinder 11 is divided by the piston 20 into two working chambers 22 and 23 which are filled with operating liquid and can be voluntarily separated from each other or connected with each other by the locking valve. A separating wall 24 defines a spring volume 25 which is filled with a pressurized gas. This pressurized gas is separated from the working chamber 23 by the separating wall 24.

In FIG. 1 the chair is illustrated in unloaded condition. According to FIG. 2 the pressure in the hydropneumatic positioning unit depends on the pressure of the pressurized gas within the volume 25. The gas pressure acts through the working chambers 23 and 22 and via the connection tube 12 onto the operating liquid within the pressure space 18 of the measuring unit 13. Under these circumstances the guiding piston 16 abuts by its lower end face the abutment member 19 so that the position of the measuring piston 15 is defined. When the locking valve between the working chambers 22 and 23 is open the piston rod 10 is biased in a direction outwards of the cavity within the cylinder 11, the spring force corresponds to the nominal pressure value of the hydropneumatic spring unit. When the seat member 3 is loaded the measuring piston is moved upwards within the measuring cylinder 14, this upward movement occurring, however, only after the weight load on the seat member 4 exceeds the biasing action of operating liquid acting onto the measuring piston 15. When the weight load exceeds this biasing action and the measuring piston 15 is moved upwards with respect to the cylinder 14, the liquid pressure within the pressure space 18 is increased. This increased pressure is transmitted through the tube 12 to the cavity of the cylinder 11 of the hydropneumatic spring unit 9. On opening of the locking valve within the piston 20 of the hydropneumatic spring unit the increased pressure results in an increased force acting onto the piston rod 10. Such the spring force acting onto the back-rest 5 is automatically adapted to the body weight of the user.

Figure 3:
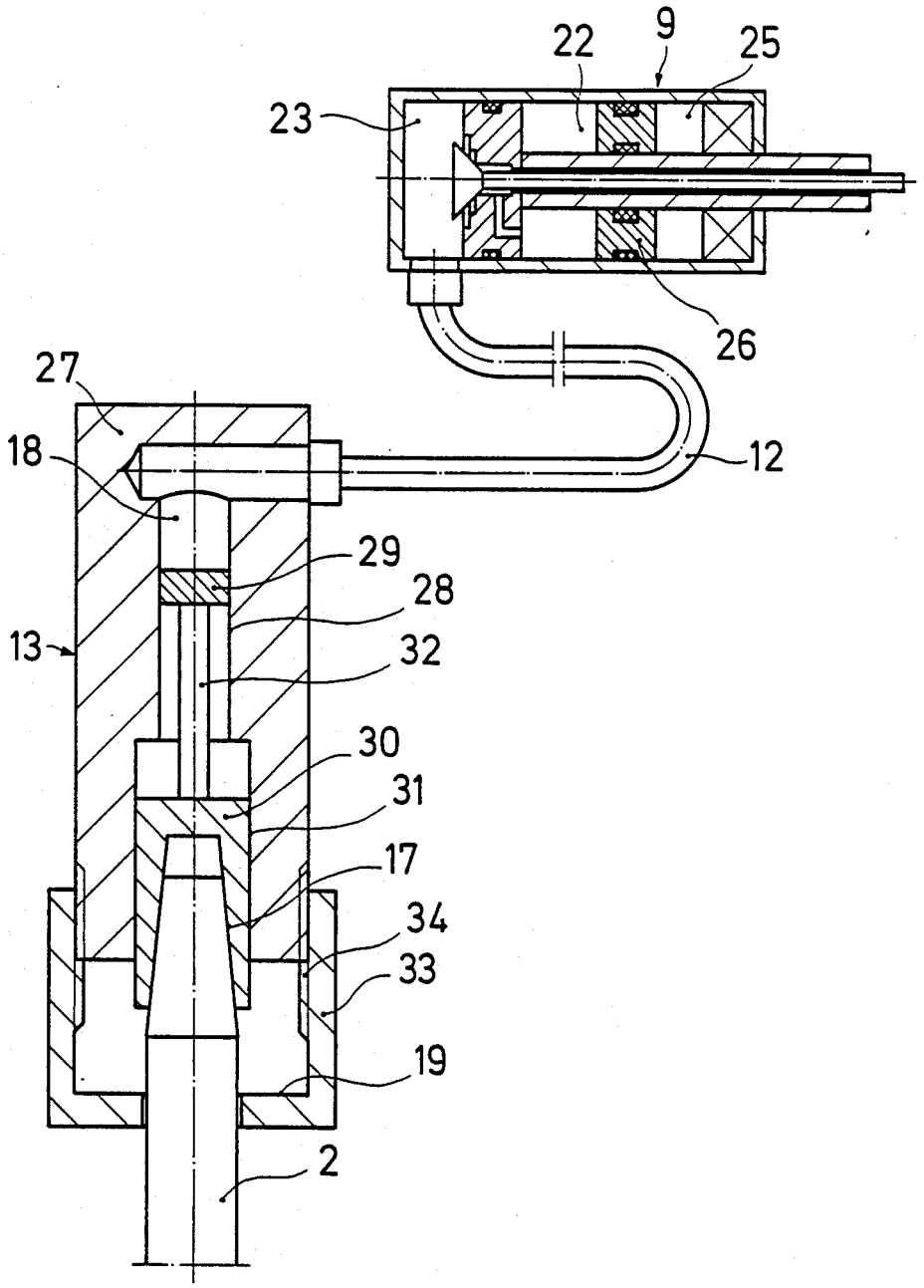
FIG. 3 shows an alternative of the spring unit.

The embodiment of FIG. 3 differs from the embodiment of FIGS. 1 and 2 essentially in that the force-measuring device comprises a modified housing 27. The upper end face of this modified housing 27 is fastened to the seat carrier. The pressure space 18 defined by the measuring piston 29 and the measuring cylinder 28 is connected by the tube 12 with the working chamber 23 of the hydropneumatic spring unit 9. The measuring piston 29 is connected by a connection rod 32 with a guiding piston 30 guided within a guiding cylinder 31. The guiding piston 30 is connected through self-locking interengaging cones, as illustrated at 17, with the central column 2. The abutment means 19 for the guiding piston 30 are provided by an abutment sleeve 33 which is adjustably mounted by thread means 34 on the housing 27. The hydropneumatic spring unit 9 differs from that one of FIG. 2 by a modified location of the gas volume 25 with respect to the working chambers 22 and 23: an annular separating wall 26 is sealingly guided on both the inner face of the cylinder 9 and the external face of the piston rod.

Figure 4:
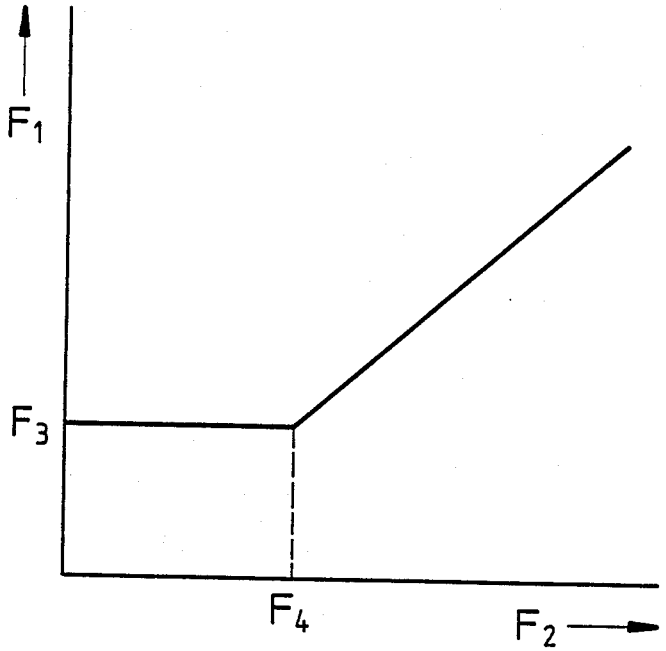
FIG. 4 shows a diagram representing the dependency of the spring force of the spring unit on the force acting onto the force-measuring device.

Supplementing the above explanations on the operation of the positioning device it is referred now to FIG. 4. In FIG. 4 $F_1$ represents the variable force exerted by the hydropneumatic spring unit when the locking valve in piston 20 is open, while $F_2$ represents the variable force exerted onto the force-measuring device 13 by the weight of the user of the chair. $F_3$ represents the value of the spring force of the hydropneumatic spring unit which results from the filling pressure in the unloaded condition. When the measuring unit is loaded a variation of the spring force of the hydropneumatic spring unit in the open valve condition occurs only after the weight of the user exceeds the force value $F_4$. Now the spring action of the hydropneumatic spring unit is increased in accordance with increasing weight force.

It is to be noted that in the embodiment of FIG. 3 in the closed valve condition no elastic medium is present in the working chamber 23 and the pressure space 18. This means that the back-rest 5 is substantially rigid against a backward force exerted by the back of the user. On the other hand, in the embodiment of FIG. 2 even in the closed valve condition there is an elastic compressible gas within the volume 25 of FIG. 2 so that a certain elastic behaviour of the back-rest is obtained. It is to be noted that the hydropneumatic spring unit of this invention may be replaced by a usual gas spring in which as seen in FIG. 2—the separating wall 24 is avoided and the chambers 22, 23 as well as the pressure space 18 are filled with a pressurized gas. The behaviour of such an arrangement is similar to the behaviour of the embodiment as shown in FIG. 2.

While specific embodiments of the invention have been shown and described in detail to illustrate the application of the inventive principles, it will be understood that the invention may be embodied otherwise without departing from such principles.

The reference numerals in the claims are only used for facilitating the understanding and are by no means restrictive.

What is claimed is:

1. A chair having a foot member (1), a seat member (4), a back-rest member (5), and means (2) for supporting the seat member in force-transmitting relation to the foot member, the improvement comprising:

a spring unit (9), said spring unit (9) comprising a cylinder member (11) having an axis and two ends and defining a cavity therein, a piston rod member (10) extending inwards and outwards of one of said ends and being movable in the axial direction of said cylinder (11), a piston unit (20) connected with said piston rod member (10) within said cavity and separating two working chambers (22, 23) from each other within said cavity, passage means interconnecting said two working chambers (22, 23), a valve means associated with said passage means for permitting voluntary interconnection and separation of said working chambers (22, 23), an operating fluid under pressure within said working chambers (22, 23), said operating fluid acting onto said piston unit (20) and said piston rod member (10) so as to drive said piston rod member (10) outwards of said cavity when said valve means is open and to position said piston rod member (10) in a substantially stationary position, when said valve means is closed, at least one of said working chambers (22, 23) being connected by fluid conduit means (12) with a pressure space (18) of a force measuring unit (13), said pressure space (18) containing operating fluid under pressure, which pressure is responsive to an external force acting onto said forcemeasuring unit (13) and determining the pressure of said operating fluid within said working chambers (22, 23), said force-measuring unit (13) being located in the force-transmission path between said chair seat member (4) and said chair foot member (1), and said spring unit (9) being in operative connection with a member (4, 5) of said chair to control the inclination of said chair member (4, 5).

2. A chair as set forth in claim 1, wherein said operating fluid is a liquid contained in said working chamber (22, 23) and said pressure space (18), said operating liquid being maintained under pressure by biasing means (24, 25).

3. A chair as set forth in claim 2, said biasing means (24, 25) comprising a volume (25) of pressurized gas.

4. A chair as set forth in claim 3, said volume (25) of pressurized gas being accommodated within said cavity.

5. A chair as set forth in claim 4, said volume (25) of pressurized gas being adjacent to and separated from one of said working chambers (22, 23) by a separating wall member (24).

6. A chair as set forth in claim 5, said separating wall member (24) being located adjacent to the working chamber (23) which is remote from said piston rod member (10).

7. A chair as set forth in claim 5, said separating wall member (24) surrounding said piston rod member (10) and being in sealing engagement with both, said piston rod member (10) and said cylinder member (11).

8. A chair as set forth in claim 1, wherein said fluid conduit means is a tube member (12).

9. A chair as set forth in claim 8, said tube member (12) being a flexible tube member.

10. A chair as set forth in claim 1, said force-measuring unit (13) comprising a housing (27) with a measuring cylinder (14; 28) defined therein, a measuring piston (15; 29) being slidable within said measuring cylinder (14; 28) said measuring space (18) being defined by said measuring piston (15; 29) within said measuring cylinder (14; 28), said housing (27) and said measuring piston (15; 29) being subject to said external force.

11. A chair as set forth in claim 10, said measuring piston (15; 29) cooperating with abutment means (19) operatively fixed with respect to said measuring cylinder (14; 28), said abutment means (19) defining the maximum volume of said pressure space (18).

12. A chair as set forth in claim 11, said abutment means (19) being adjustable along an axis of said measuring cylinder (14; 28).

13. A chair as set forth in claim 12, said abutment means (19) comprising an abutment member (33) having internal thread means (34), said internal thread means (34) being engageable with external thread means of said housing (27).

14. A chair as set forth in claim 10, said measuring piston (15) having a longitudinal extent larger than the diameter thereof.

15. A chair as set forth in claim 14, said measuring piston (15) having an extent of at least 1.5 times the diameter thereof.

16. A chair as set forth in claim 10, said measuring piston (29) being connected with a guiding piston (30), said guiding piston (30) being guided in a guiding cylinder (31) of said housing (27).

17. A chair as set forth in claim 16, said measuring piston (29) being connected with said guiding piston (30) by a connecting rod (32).

18. A chair as set forth in claim 10, said measuring piston (15, 29) being provided with a conical inner surface for self-locking engagement with a first force-transmitting member (2) having a corresponding outer conical surface.

19. A chair as set forth in claim 18, said inner conical surface being provided within said guiding piston (30).

20. A chair as set forth in claim 10, said housing (27) being provided with engagement means for engagement with a second force-transmitting member (4).

21. A chair as set forth in claim 1, wherein said force-measuring unit (13) includes a housing (27) fixed with respect to a seat member carrier (3), and said spring unit (9) is connected with said seat member carrier (3), on the one hand, and said chair member (4, 5), on the other hand.

22. A chair as set forth in claim 1 wherein said spring unit (9) is in operative connection with said back-rest member (5) to control the inclination thereof.

23. A positioning device comprising a spring unit (9), said spring unit (9) comprising a cylinder member (11) having an axis and two ends and defining a cavity therein, a piston rod member (10) extending inwards and outwards of one of said ends and being movable in the axial direction of said cylinder (11), a piston unit (20) connected with said piston rod member (10) within said cavity and separating two working chambers (22, 23) from each other within said cavity, passage means interconnecting said two working chambers (22, 23), a valve means associated with said passage means for voluntarily interconnecting and separating said working chambers (22, 23), an operating fluid under pressure within said working chambers (22, 23), said operating fluid acting onto said piston unit (20) and said piston rod member (10) so as to drive said piston rod member (10) outwards of said cavity when said valve means is open and to position said piston rod member (10) in a substantially stationary position when said valve means is closed, at least one of said working chambers (22, 23) being connected by fluid conduit means (12) with a pressure space (18) of a force measuring unit (13), said force-measuring unit (13) comprising a housing (27) with a measuring cylinder (14, 28) defined therein, a measuring piston (15, 29) being slidable within said measuring cylinder (14, 28) and defining said measuring space (18) within said measuring cylinder (14, 28), and said pressure space (18) containing operating fluid under pressure which is responsive to an external force acting onto said force-measuring unit (13) and determining the pressure of said operating fluid within said working chambers (22, 23), said measuring piston (15, 29) cooperating with abutment means (19) adjustable along the axis of said measuring cylinder (14, 28) and defining the maximum volume of said pressure space (18).

24. A positioning device comprising a spring unit (9), said spring unit (9) comprising a cylinder member (11) having an axis and two ends and defining a cavity therein, a piston rod member (10) extending inwards and outwards of one of said ends and being movable in the axial direction of said cylinder (11), a piston unit (20) connected with said piston rod member (10) within said cavity and separating two working chambers (22, 23) from each other within said cavity, passage means interconnecting said two working chambers (22, 23), a valve means associated with said passage means for voluntarily interconnecting and separating said working chambers (22, 23), an operating fluid under pressure within said working chambers (22, 23), said operating fluid acting onto said piston unit (20) and said piston rod member (10) so as to drive said piston rod member (10) outwards of said cavity when said valve means is open and to position said piston rod member (10) in a substantially stationary position when said valve means is closed, at least one of said working chambers (22, 23) being connected by fluid conduit means (12) with a pressure space (18) of a force measuring unit (13), said force-measuring unit (13) comprising a housing (27) with a measuring cylinder (14, 28) defined therein, a measuring piston (15, 29) being slidable within said pressure cylinder (14, 28) and defining said measuring space (18) within said measuring cylinder (14, 28), said measuring piston (29) being connected with a guiding piston (30) guided within a guiding cylinder (31) of said housing (27), said pressure space (18) containing operating fluid under pressure which is responsive to an external force acting onto said force-measuring unit (13) and determining the pressure of said operating fluid within said working chambers (22, 23).

* * * * *

UNITED STATES PATENT AND TRADEMARK OFFICE

CERTIFICATE OF CORRECTION

PATENT NO. : 4,830,432

DATED : May 16, 1989

INVENTOR(S) : Castor Fuhrmann et al.

It is certified that error appears in the above-identified patent and that said Letters Patent is hereby corrected as shown below:

Col.5, line 4, after "of" insert --the--;
Col.5, line 14, "10. Such" should read --10, and--;
Col.5, line 64, "which as" should read --which - as--;
Col.6, line 39, "forcemeasure-" should read --force-measur- --;
Col.6, line 49, "chamber" should read --chambers--;
Col.6, line 67, after "both" delete the comma;
Col.8, line 53, "measuring" should be --pressure--;
Col.8, line 56, "measuring" should be --pressure--.

Signed and Sealed this

Twenty-fifth Day of September, 1990

*Attest:*

HARRY F. MANBECK, JR.

*Attesting Officer*

*Commissioner of Patents and Trademarks*